United States Patent [19]

Nixon

[11] 4,193,014

[45] Mar. 11, 1980

[54] DISPLAY ARRANGEMENTS

[75] Inventor: Ralph D. Nixon, Braintree, England

[73] Assignee: English Electric Valve Company Limited, Chelmsford, England

[21] Appl. No.: 805,035

[22] Filed: Jun. 9, 1977

[30] Foreign Application Priority Data

Jul. 10, 1976 [GB] United Kingdom ..... 28793/76
Sep. 9, 1976 [DE] Fed. Rep. of Germany ..... 2640632

[51] Int. Cl.[2] ..... H01J 31/66; H01J 29/80
[52] U.S. Cl. ..... 313/396; 313/495
[58] Field of Search ..... 313/495, 422, 396, 411, 313/410, 400, 401

[56] References Cited

U.S. PATENT DOCUMENTS

| | | | |
|---|---|---|---|
| 2,926,286 | 2/1960 | Skellett | 313/495 X |
| 2,964,672 | 12/1960 | Nixon | 313/410 X |
| 2,978,608 | 4/1961 | Gaffney | 313/411 X |
| 3,382,392 | 5/1968 | Corpew | 313/410 |
| 3,651,361 | 3/1972 | Tanaka et al. | 313/410 |
| 3,936,697 | 2/1976 | Scott | 313/495 X |
| 3,950,669 | 4/1976 | Smith | 313/395 X |

*Primary Examiner*—Robert Segal
*Attorney, Agent, or Firm*—Diller, Ramik & Wight

[57] ABSTRACT

An addressable display in which data is presented in the form of a rectangular dot array is provided by means of an evacuated cathode ray tube, which enables large bright displays to be achieved. The cathode ray tube contains two segmented mesh electrodes each consisting of separately addressable stripes. Electrons from a flood gun are passed by both electrodes only at the crossing point of two stripes, one on each electrode, when predetermined potentials are applied to them.

5 Claims, 2 Drawing Figures

DISPLAY ARRANGEMENTS

This invention relates to a display arrangement which is capable of presenting relatively large, very bright and readily alterable displays with a moderate power consumption.

According to this invention, a display arrangement includes a cathode ray tube having an electron flood gun arranged to illuminate two segmented mesh electrodes mounted one behind the other adjacent to a fluorescent screen, each segment of the mesh electrodes being individually addressable to control passage of electrons therethrough.

Preferably, each segmented mesh electrode consists of a set adjacent parallel stripes, each stripe being an individually addressable segment and the stripes in one segmented mesh electrode being in crossing relationship with the stripes of the other segmented mesh electrode. So that each segment is individually addressable, adjacent segments are electrically insulated from each other.

Preferably again, the stripes of the two segmented electrodes cross at right angles.

Each segment consists of a grid or mesh-like conductive material, and it is not essential that the pitch of the mesh forming the different electrodes be the same. It may be preferable to provide the segmented mesh electrode nearest the flood gun with a coarser pitch to increase its transmission ratio in respect of the incident flood beam of electrons.

Figure 1:
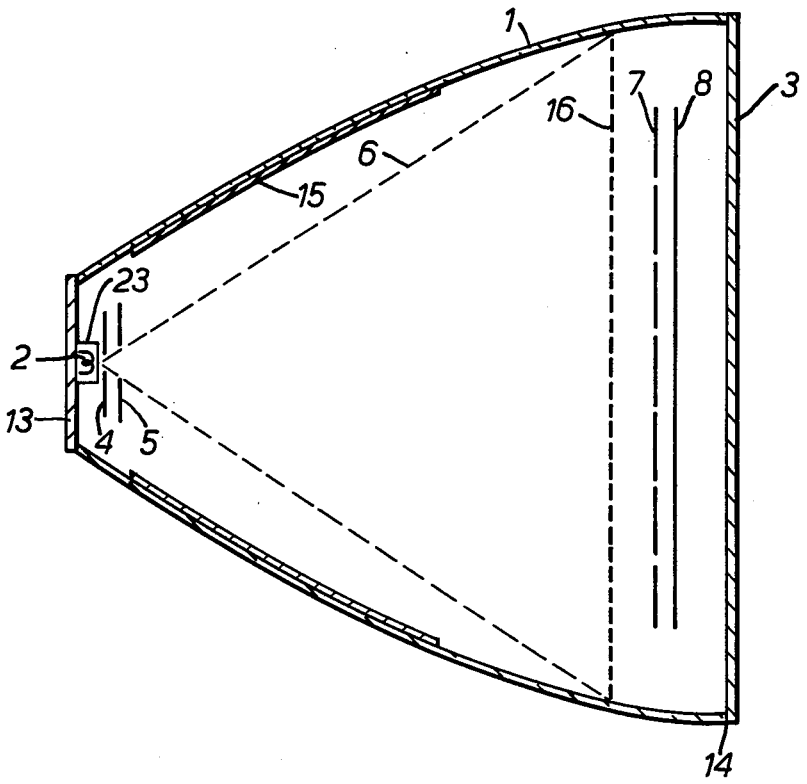
Figure 2:
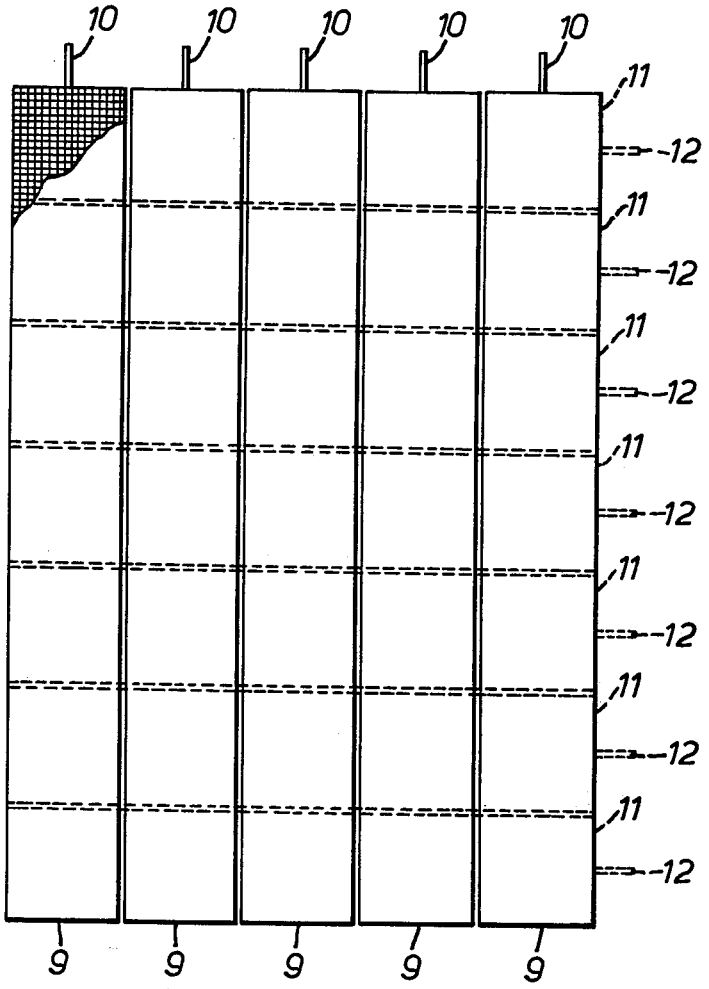

The invention is further described by way of example, with reference to the accompanying drawings in which FIG. 1 shows a section view of a display arrangement in accordance with the present invention, and FIG. 2 shows a portion thereof in greater detail.

Referring to the drawings, the display arrangement consists of a cathode ray tube 1 having a flood gun 2 at one end, and a fluorescent screen 3 at the other end. The flood gun 2 produces a wide solid cone of electrons when it is energised, and not the narrow pencil-like beam which is so often associated with cathode ray tubes. Flood guns, however, are well known and so will not be described in detail here—they are used in conventional storage tubes for example. The flood gun 2 consists of a cathode 23, grid 4 and anode 5, and produces a wide beam 6 which illuminates two segmented mesh electrodes 7 and 8.

The two segmented mesh electrodes 7 and 8 are shown in greater detail in FIG. 2—they are drawn as seen from the direction of the fluorescent screen 3, and it can be seen that both consists of segments in the form of parallel stripes. The segmented mesh electrode 8 consists of five vertical segments 9, termed columns, which are electrically insulated from each other, and each segment is provided with a separate electrical connection point 10. The segmented mesh electrode 7 consists of seven horizontal segments 11 termed rows (which are shown in broken lines for the sake of clarity) which also are electrically insulated from each other and from the segments 9 of the other electrode 8. Each segment 11 is provided with an electrical connection point 12.

Each segment consists of an open mesh made of an electrically conductive portion, which may, for example, be formed by a fine matrix of crossing wires. A portion of this mesh-like structure is illustrated at the top-left corner of FIG. 2. The open mesh permits electrons to pass readily through the interstices with little physical interruption, and the passage of electrons is controlled by the potential present on a particular segment. The mesh is typically about 500 lines/inch. It is only those electrons which pass through both segmented mesh electrodes 7 and 8 that produce a bright visible image when they strike the fluorescent screen 3. It is not necessary for both segmented mesh electrodes to be made from mesh of the same pitch, and it may be desirable for the segmented electrode 7 to be of coarser pitch or higher transmission ratio to obtain the brightest display.

Each segment is provided with a separate electrical lead passing through the envelope of the tube 1 so that each segment is separately addressable. The leads can be taken out through the base 13 of the tube 1 along with the leads for the electron gun 2, or they can be taken off through a sealed joint 14 between the body of the tube 1 and the screen 3.

As is usual with cathode ray tubes, a cone shaped electrode 15 is provided, and in practice usually consists of a graphite or aluminium coating on the inside wall of the tube.

A collector mesh 16 (otherwise known as a field grid or field mesh) is positioned closely adjacent to the mesh 7 on the flood gun side of it. It is spaced a millimeter or so from the mesh 7, and the two mesh electrodes 7 and 8 are spaced apart by about the same amount. Each mesh electrode 7 and 8 is mounted on its own supporting plate. The supporting plates are not illustrated but each consists of an opaque plate having apertures corresponding to the shape of the mesh segments to be supported. The supporting plates in addition to providing mechanical support for the mesh segments also prevent electrons passing between the different adjacent segments which make up a complete segmented mesh electrode. The segments are conveniently attached to the appropriate supporting plate by means of an electrically insulating adhesive applied around the periphery of the segment. It is, of course, necessary to maintain electrical isolation between the various segments so that each can be addressed individually.

In operation, the cathode 23 is held at 0 volts, the anode 5 at +100 volts, the cone shaped electrode 15 at +10 volts and the collector mesh at +10 volts. The values are approximate and may require slight adjustment for individual displays. The connection to the fluorescent screen 3 is held at about +10 K volts.

When the connections 10 and 12 to the rows 9 and columns 11 respectively of the segmented mesh electrodes 7 and 8 are held at cathode potential (i.e. zero volts) or just a few volts negative, the fluorescent screen 3 remains dark as no electrons from the flood gun 2 reach it. If, say, a row 11 is held a few volts positive the screen remains dark as long as the columns 9 remain at cathode potential, but if both a row and a column are held a few volts positive with respect to the cathode a bright area appears on the screen 3 corresponding to the cross-over region of the row and the column.

Typical figures, by way of example, are −2 volts on mesh electrode 8 and zero volts on mesh electrode 7 to produce cut-off of the electron beam, i.e. a "dark" display, and +3 volts on mesh electrode 8 and +5 volts on mesh electrode 7 to produce a bright region. By sampling the columns rapidly one at a time (e.g. at a few hundred Hertz or more) and pulsing positively the appropriate rows, a pattern of bright regions is produced on the screen 3, and by choosing the correct rows and columns alpha-numeric characters are displayed.

Drive circuits which produce the signals necessary to generate a particular character are now well known and readily available, since such circuits are used to drive certain kinds of light-emitting-diode arrays. The actual level of the drive signals required for the rows and columns can be readily found, but are typically as given above. The value is dependent partly on the pitch of the mesh itself, and as previously mentioned the pitch of one segmented mesh electrode may differ from that of the other.

As stated previously the potential present on the collector mesh 16 is about +10 volts relative to the cathode, and this contrasts with usual practice for cathode ray tubes as when such a collector mesh is provided, as for example in storage tubes, a potential of the order of +100 volts or more is applied to it. However, it has been found that by applying a much lower voltage, the overall length of the tube 1 can be greatly reduced. In fact, the length can be reduced to about half the value previously required. Typically a length of about 3 inches for a tube in accordance with this invention having a display area on the screen 3 of about 3 inches square is possible. It is believed that this reduction in length is obtainable because the low potential of about +10 volts on the collector mesh 16 allows the cone of electrons to spread outwards to a greater extent, and that a space charge region is formed in the vicinity of the collector mesh 16. The electrons are moving relatively slowly at this point, and it is thought that they are drawn from the space charge region by approximately energised portions of the segmented mesh electrodes 7 and 8 and accelerated by the potential of about 10 kV on the screen 3.

Whether or not the foregoing theory and beliefs are correct, the use of the low voltage permits the tube 1 to be made in a very compact form. The value of +10 volts is approximate, and in some respects a value of +8 volts is about the optimum value, but the collector mesh 16 can be operated at potentials between zero and +15 volts with very acceptable results.

The use of the low voltage in accordance with this invention has been found to result in a linear relationship between the potential on the accelerator grid of the flood gun, and the brightness of the display as measured by the screen current. This property is useful for setting up and matching tubes.

It has also been found that the display is less susceptible to external magnetic fields; this results in less shielding being necessary and permits economies of construction to be made.

It is possible to produce very bright displays using this invention, and the character displayed can readily be altered as required. By the use of greater numbers of rows and columns more complex characters can be displayed.

I claim:

1. A display arrangement comprising a cathode ray tube, said cathode ray tube including an electron flood gun comprising a cathode, an anode and an accelerating grid disposed between said cathode and said anode whereby said flood gun emits a wide solid cone of electrons, a fluorescent screen and an electrode for controlling the passage of electrons from the electron flood gun to the fluorescent screen, two adjacent and superposed segmented mesh electrodes mounted adjacent to said fluorescent screen, each segmented mesh electrode comprising a set of adjacent parallel co-planar open mesh stripes electrically insulated from each other, each stripe being individually addressable and the open mesh of each stripe presenting a pattern of interstices which are closely spaced both transversely across and longitudinally along each such stripe to permit electrons to pass through the interstices with little physical interruption, and the stripes of one segmented mesh electrode being in crossing relationship to the stripes of the other segmented mesh electrode, whereby an addressed stripe of said one electrode and an addressed stripe of said other electrode in combination control the passage of electrons through said two segmented mesh electrodes onto said screen at and throughout a region of their common crossing.

2. A display arrangement as claimed in claim 1 and wherein the stripes of the two segmented electrodes cross at right angles.

3. A display arrangement as claimed in claim 1 and wherein the segmented mesh electrode nearest the flood gun is provided with a coarser pitch than the segmented mesh electrode nearest the fluorescent screen.

4. A display arrangement as claimed in claim 1 and wherein a collector mesh is positioned between the flood gun and the segmented mesh electrode nearest to the flood gun, and in operation a potential in the range of zero volts to +15 volts (relative to cathode potential) is applied to the collector mesh.

5. A display arrangement as claimed in claim 5 and wherein said potential is approximately +10 volts.

* * * * *